United States Patent [19]

Kirchhoff

[11] 4,265,031

[45] May 5, 1981

[54] ROTARY DRUM MOUNTED BY MEANS OF RUNNING RINGS

[75] Inventor: Bernhard Kirchhoff, Ennigerloh, Fed. Rep. of Germany

[73] Assignee: O&K Orenstein & Koppel Aktiengesellschaft, Berlin, Fed. Rep. of Germany

[21] Appl. No.: 94,538

[22] Filed: Nov. 15, 1979

[30] Foreign Application Priority Data

Nov. 15, 1978 [DE] Fed. Rep. of Germany ..... 2849490

[51] Int. Cl.[3] ..... F26B 25/02

[52] U.S. Cl. ..... 34/108; 34/121; 29/115; 366/60; 432/103

[58] Field of Search ..... 64/4; 432/103, 104; 34/108, 121; 366/60, 220; 29/115

[56] References Cited

U.S. PATENT DOCUMENTS

| | | | |
|---|---|---|---|
| 2,249,831 | 7/1941 | How | 34/108 |
| 2,999,396 | 9/1961 | Kaczmarski | 34/108 |
| 3,561,132 | 2/1971 | La Grone | 34/108 |
| 4,030,878 | 6/1977 | Kunath | 432/103 |

*Primary Examiner*—Larry I. Schwartz

*Attorney, Agent, or Firm*—Martin A. Farber

[57] ABSTRACT

A rotary drum for the heat treatment of bulk goods, with the drum being mounted by means of thrust rings. Wedges are arranged on the outer periphery of the shell of the rotary drum, the wedges being disposed opposite to one another at a spacing corresponding approximately to the width of the thrust ring. Those inclined surfaces of the wedges which inclined surfaces face toward each other cooperate with insert pieces, the insert pieces being fastened on the thrust ring and being provided with counterwedge surfaces. The inclined surfaces of the wedges and the counterwedge surfaces are arranged on the outer periphery of the shell of the rotary drum successively flip symmetrically.

9 Claims, 5 Drawing Figures

FIG. 1
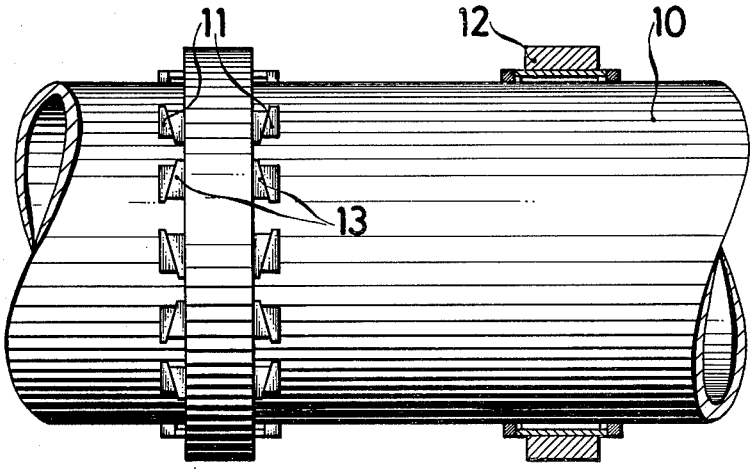
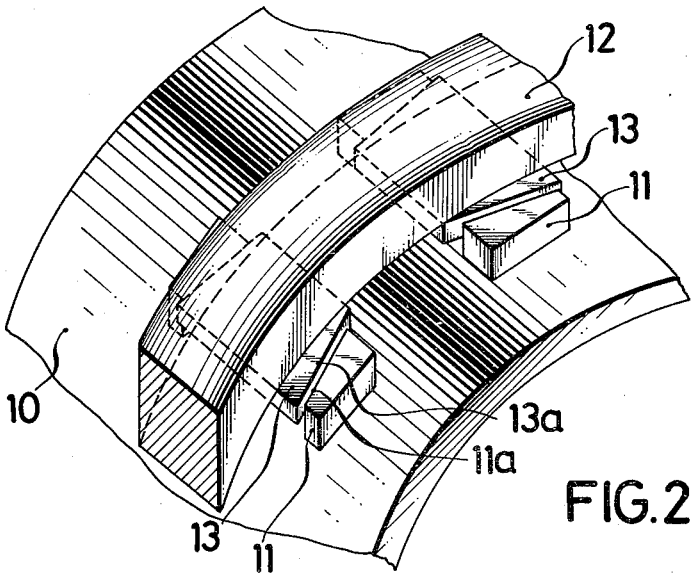
FIG. 2

ROTARY DRUM MOUNTED BY MEANS OF RUNNING RINGS

The invention relates to a rotary drum, mounted by means of barrel or thrust rings, for the heat treatment of bulk goods.

With a known arrangement axially welded bridge plates grip or mesh into a toothed barrel ring. This measure and additional wedges which upon wearing out must be adjusted or reset, considerably reduce unobstructed radial heat expansion of the rotary tube; moreover an additional axial securing is necessary and constant service and maintenance must be provided.

It is an object of the invention to produce a barrel ring securing or attachment which makes it possible for the shell of the rotary drum to expand axially and radially free of constraint, and for the transmission of force from the rotary drum shell to the barrel ring to be distributed at as many points as possible. Moreover the barrel ring must be axially secured, heat removal under the barrel ring must occur and the barrel ring must be simple to mount and maintenance-free.

The solution of this objective is that the wedges are arranged on the outer periphery of the shell of the rotary drum, the wedges being opposite to one another at a spacing corresponding approximately to the width of the thrust ring, those inclined surfaces of the wedges which inclined surfaces face toward each other cooperating with insert pieces, which insert pieces are fastened on the barrel ring and are provided with counterwedge surfaces, the wedge surfaces and the counterwedge surfaces are arranged on the outer periphery of the casing of the rotary drum successively flip symmetrically.

The advantage of the arrangement in accordance with the invention resides in that the shell of the rotary tube is held by the wedge pieces such that flattenings of the shell of the rotary tube can no longer occur or only to a small non-dangerous degree and a constriction or contraction of the rotary tube and consequently a destruction of the lining or masonry by overstressing is avoided. Variable uncontrollable heat stresses are converted into harmless length changes without reducing or impairing the guidance and the support function of the barrel or thrust ring. The connection elements, wedge surfaces and counterwedge surfaces of the thrust ring and of the rotary tube adjust smoothly without external influence. A readjustment during the operation is not necessary.

Figure 3:
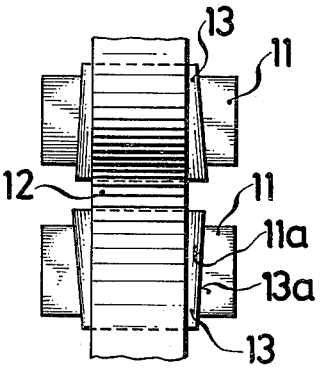
Figure 4:
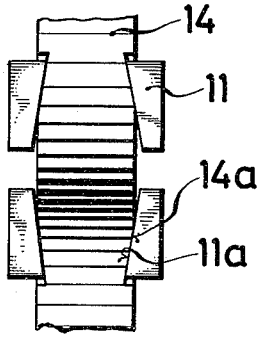
Figure 5:
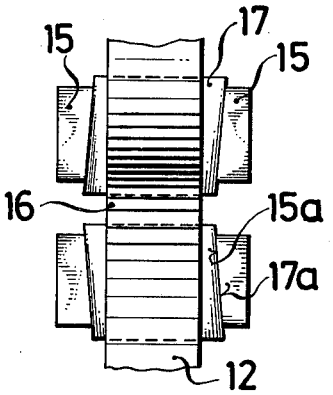

With the above and other objects and advantages in view, the present invention will become more clearly understood in connection with the detailed description of a preferred embodiment, when considered with the accompanying drawings, of which:

FIG. 1 is a top plan view of a rotary drum with barrel rings,

FIG. 2 is a perspective, partial illustration of the rotary drum and barrel ring with a fastening by means of wedges arranged on the rotary drum and counterwedges in trapezoidal form, the latter being or mounted rigidly on the barrel ring, FIG. 3 is a plan view of a fastening by means of wedges arranged on the rotary drum and counterwedges in trapezoidal form, the latter being rigidly mounted on the thrust or barrel ring, FIG. 4 is a top plan view of a part of the barrel ring with inclined counterwedge surfaces for the wedges which are mounted on the rotary drum, FIG. 5 is a top plan view of a part of the thrust ring with parallelogram-shaped counterwedge surfaces which are fastened to the first ring.

Pairs of wedges 11 are rigidly arranged opposite one another on the rotary drum 10, the inclined surfaces 11*a* of which wedges 11 face toward the barrel ring 12, on which barrel ring 12 trapezoidal-shaped wedges 13 are rigidly affixed (FIGS. 2 and 3), the inclined surfaces 13*a* of the wedges 13 forming counterwedge surfaces for the inclined surfaces 11*a*. Adjacent groups of wedges 11 and 13 (two groups being illustrated in FIG. 2), which wedges are arranged in succession around the periphery of the drum, are each oppositely directed with their inclined surfaces toward one another, so that the force or power transmission from the shell of the rotary drum to the thrust rings can take place in both directions and the support action is maintained.

Since a plurality of wedges is applied on and around the entire periphery of the rotary drum and, respectively, on and around the rings, the force or power transmission takes place via many points. The reciprocal driving along of the rotary drum and thrust rings can, according to FIG. 4, also occur when inclined surfaces 14*a* are formed in the barrel or thrust ring 14, which inclined surfaces 14 cooperate with the inclined surfaces 11*a* of the wedges 11.

In a further embodiment according to FIG. 5, the wedges 15 (which wedges are arranged in pairs on both sides of the barrel or thrust ring 12 on the rotary drum 10), have inclined surfaces 15*a*, which are parallel to one another and cooperate with a counterbody 17, the latter being fastened to the barrel or thrust ring 16, the inclined surfaces 17*a* of the counterbody 17 extending parallel to the inclined surfaces 15*a* of the wedges 15. The reciprocal driving along of the rotary drum 10 and of the thrust ring 16 occurs here because the corresponding inclined surfaces of the wedges 15 and of the counterbody 17 of one group are inclined in an opposite direction to the inclined surfaces of an adjacent group of wedge 15 and counterbody 17.

I claim:

1. A rotary drum for the heat treatment of bulk goods, the drum being mounted by means of thrust rings, comprising a rotary drum having an outer shell, a thrust ring disposed around said outer shell, wedges being mounted on the outer periphery of the shell of the rotary drum, said wedges being disposed opposite to one another at a spacing corresponding approximately to the width of said thrust ring, said wedges having inclined surfaces facing toward each other, portions constituting insert pieces being secured to said thrust ring, said insert pieces having counterwedge surfaces cooperating with said inclined surfaces of said wedges, said inclined surfaces and said counterwedge surfaces are disposed on the outer periphery of the shell of the rotary drum successively "flip" symmetric.

2. The rotary drum as set forth in claim 2, wherein said inclined surfaces and said counterwedge surfaces are line symmetric with respect to imaginary lines between spaced adjacent said wedges in a circumferential direction, said lines being parallel to the axis of the drum.

3. The rotary drum as set forth in claim 2, wherein further said inclined surfaces and said counterwedge surfaces are line symmetric with respect to an imaginary circumferential line parallel to and centrally with respect to said thrust ring.

4. The rotary drum as set forth in claim 1, wherein said insert pieces are fastened to a bottom of said thrust ring, the latter and said insert pieces being spaced from the outer periphery of the shell of said rotary drum.

5. The rotary drum as set forth in claim 1, wherein said wedges and counterwedges are trapezoidal.

6. The rotary drum as set forth in claim 1, wherein said insert pieces are separate members from said thrust ring and secured thereto.

7. The rotary drum as set forth in claim 6, wherein said insert pieces are wider than said thrust ring and overlap said thrust ring.

8. The rotary drum as set forth in claim 1, wherein said insert pieces constitute recessed side portions of said thrust ring, said counterwedge surfaces constituting recesses in the sides of said thrust ring.

9. The rotary drum as set forth in claim 1, wherein said wedges are arranged in pairs on opposite sides of said thrust ring, said inclined surfaces of each of said pairs are parallel to each other, respectively.

* * * * *